US011178935B2

(12) United States Patent
Iglesias et al.

(10) Patent No.: US 11,178,935 B2
(45) Date of Patent: Nov. 23, 2021

(54) REMOVABLE LEG WALKER

(71) Applicant: OVATION MEDICAL, Agoura Hills, CA (US)

(72) Inventors: Joseph Michael Iglesias, Agoura Hills, CA (US); Tracy E. Grim, Thousand Oaks, CA (US)

( * ) Notice: Subject to any disclaimer, the term of this patent is extended or adjusted under 35 U.S.C. 154(b) by 307 days.

(21) Appl. No.: 16/533,650

(22) Filed: Aug. 6, 2019

(65) Prior Publication Data

US 2019/0357629 A1 Nov. 28, 2019

Related U.S. Application Data

(63) Continuation of application No. 13/441,552, filed on Apr. 6, 2012, now Pat. No. 10,863,791.

(60) Provisional application No. 61/472,946, filed on Apr. 7, 2011.

(51) Int. Cl.
*A43B 13/14* (2006.01)

(52) U.S. Cl.
CPC ..... *A43B 13/145* (2013.01); *A43B 13/143* (2013.01)

(58) Field of Classification Search
CPC .. A43B 7/142; A43B 7/22; A43B 7/00; A43B 13/12; A43B 13/141; A61F 5/0195; A61F 5/011; A61F 5/0585; A61F 13/14; A61F 13/06
See application file for complete search history.

(56) References Cited

U.S. PATENT DOCUMENTS 4,989,349 A * 2/1991 Ellis, III ..... A43B 5/00 36/25 R
5,317,819 A * 6/1994 Ellis, III ..... A43B 5/00 36/114
5,971,946 A * 10/1999 Quinn ..... A61F 5/0127 602/27
6,269,554 B1 * 8/2001 Silvestrini ..... A43B 7/144 36/140
6,793,638 B1 * 9/2004 DeToro ..... A61F 5/0127 128/882
7,291,181 B1 * 11/2007 Lyons ..... A43B 7/20 623/33
7,418,755 B2 * 9/2008 Bledsoe ..... A43B 7/28 12/142 N
7,922,677 B2 * 4/2011 Daiju ..... A61F 5/0125 602/5
2001/0027616 A1 * 10/2001 Silvestrini ..... A43B 7/1465 36/144
2001/0049887 A1 * 12/2001 Ells, III ..... A43B 13/141 36/25 R
2002/0073578 A1 * 6/2002 Ellis, III ..... A43B 13/143 36/25 R
2005/0016020 A1 * 1/2005 Ellis, III ..... A43B 13/18 36/25 R
2005/0131324 A1 * 6/2005 Bledsoe ..... A61F 5/0111 602/23
2005/0171461 A1 * 8/2005 Pick ..... A61F 5/0111 602/27

(Continued)

*Primary Examiner* — Megan E Lynch
(74) *Attorney, Agent, or Firm* — Fulwider Patton LLP

(57) ABSTRACT

An orthopedic walking boot for a user includes an outer sole having a substantially continuously curved lateral profile bottom walking surface, wherein a radius of curvature of the lateral walking surface varies between 10 mm and infinity, and an upper portion arranged with the outer sole to support a lower portion of the user's leg.

3 Claims, 4 Drawing Sheets

(56) References Cited

U.S. PATENT DOCUMENTS

2007/0107267 A1* 5/2007 Hodgson ..... A43B 13/141 36/129
2007/0293798 A1* 12/2007 Hu ..... A61F 5/0111 602/27
2008/0060220 A1* 3/2008 Lyden ..... A43B 21/26 36/27
2009/0099495 A1* 4/2009 Campos ..... A61F 5/0127 602/27
2009/0133292 A1* 5/2009 Salvatelli ..... A43B 7/147 36/110
2009/0199429 A1* 8/2009 Ellis ..... A43B 13/187 36/29
2009/0287127 A1* 11/2009 Hu ..... A61F 5/012 602/27
2010/0010410 A1* 1/2010 Hu ..... A61F 5/0195 602/23
2010/0100018 A1* 4/2010 Fout ..... A61F 5/0111 602/13
2010/0275471 A1* 11/2010 Teteriatnikov ..... A43B 13/145 36/30 R
2010/0307028 A1* 12/2010 Teteriatnikov ..... A43B 13/145 36/108
2011/0009791 A1* 1/2011 Hopmann ..... A61F 5/0585 602/23
2011/0078923 A1* 4/2011 Bartholet ..... A43B 13/187 36/92
2011/0113649 A1* 5/2011 Merritt ..... A43B 13/145 36/102
2011/0196276 A1* 8/2011 Kuhn ..... A61F 5/0127 602/27
2012/0137544 A1* 6/2012 Rosa ..... A43B 7/143 36/105
2013/0226059 A1* 8/2013 Morris ..... A61F 5/0127 602/27

* cited by examiner

REMOVABLE LEG WALKER

CROSS-REFERENCES TO RELATED APPLICATIONS

This application is a continuation which is based on the U.S. Ser. No. 13/441,552, filed on Apr. 6, 2012, which claims priority from U.S. Ser. No. 61/472,946, filed Apr. 7, 2011, incorporated by reference in their entirety.

BACKGROUND

It is common that people, especially active and/or frail people, experience a variety of lower leg and ankle injuries. To aid in the treatment of the injuries it is desirable to immobilize the injury, typically above and below the effected joint.

Physicians traditionally will place patients in a cast that will start at the toes and ends below the knee in what is called a short leg cast. Physicians have noticed that casts are hot, promote skin itching and will rub the leg when the swelling subsides.

An alternative to the short leg cast is a short leg walker that is made of rigid plastic frame lined with a soft padding to accommodate the leg comfortably. Many times the liner, or soft good, may house a series of air bladders that can be adjusted by the patient to improve the fit and help compress the swelling resulting in less pain and more stability. The walkers can be removed when directed to address skin issues, remove sutures or conduct passive range of motion (ROM) exercises. Circumferential casts do not offer the luxury of easy on/off.

Walkers are essentially rigid encasing envelopes for the leg that usually immobilize the foot and ankle at a neutral position (or 90 degrees). The patient can walk easiest if the ankle is frozen at 90 degrees. Otherwise the patient would be walking on the toes or on the heel. The sole is usually tapered from front to back in a rocker bottom fashion to initiate a smoother stride from front to back allowing heel strike, rocking forward then toe-off for a successful step. The sole taper may facilitate forward walking motion, but is not helpful in pivoting to turn.

As shown in FIGS. 1 and 2, a depiction of a prior art orthopedic walking boot 100 having a sole 110 with an edge 115 is shown tilted at an angle, such as may occur when a user wishes to pivot to turn, rather than walk in a straight line. The curvature of the sole 110 at either side includes an arcuate edge 115; however, the radius of curvature of the arcuate edge 115 may conventionally be so small that the contact surface of the sole with the ground at the arcuate edge 115 is too small to afford the user stability in the effort to turn or may even hinder the turn due to effectively balancing on an edge, e.g., like a skate blade. As shown in FIG. 2, a typical ratio of the dimension of a substantially flat portion 112 of the sole 110 having a lateral dimension A to a total lateral dimension B, including the two arcuate edges 115, may conventionally be on the order of 0.85 or greater, meaning that the sole is mostly or substantially flat over 85% of the surface of the sole that may make contact with a walking surface. A limited portion at the arcuate edges 115 having curvature upward toward an upper portion 120 of the boot 100 at the sides makes actual contact with the ground. In this configuration, the shape of the sole tends to resist the effort to pivot into the turn, adding stress and discomfort to the user's leg, which may adversely affect recuperation.

Conventional walker boots typically include a break in the curvature from the bottom surface laterally to the vertical sidewall, and lacks a continuously curved (i.e., rolled) edge. In addition, the sole has no provisions for traction on the sidewalls.

There is a need, therefore, to shape the sole of the orthopedic walker boot to improve the user experience, comfort and mobility.

SUMMARY OF THE INVENTION

In an aspect of the disclosure, an orthopedic walking boot for a user includes an outer sole having a substantially continuously curved lateral profile bottom walking surface, wherein a radius of curvature of the lateral walking surface varies between 10 mm and infinity, and an upper portion arranged with the outer sole to support a leg of the user.

In another aspect of the disclosure, an orthopedic walking boot for a user includes an outer sole having a substantially continuously curved lateral profile bottom walking surface, a traction tread on substantially all of the curved bottom of the outer sole, and an upper portion arranged with the outer sole to support a leg of the user, wherein the sole profile curves substantially continuously to merge with the upper portion.

In a further aspect of the disclosure, an orthopedic walking boot for a user includes an outer sole having a bottom surface with a substantially continuously curved lateral profile and front-to-back rolling curvature, and an upper portion arranged with the outer sole to support a leg of the user.

In a still further aspect of the disclosure, an orthopedic walking boot for a user includes an outer sole comprising a primary material and one or more secondary materials, wherein the secondary materials have a greater shock absorbing characteristic than the primary material.

DETAILED DESCRIPTION OF THE PREFERRED EMBODIMENTS

Figure 1:
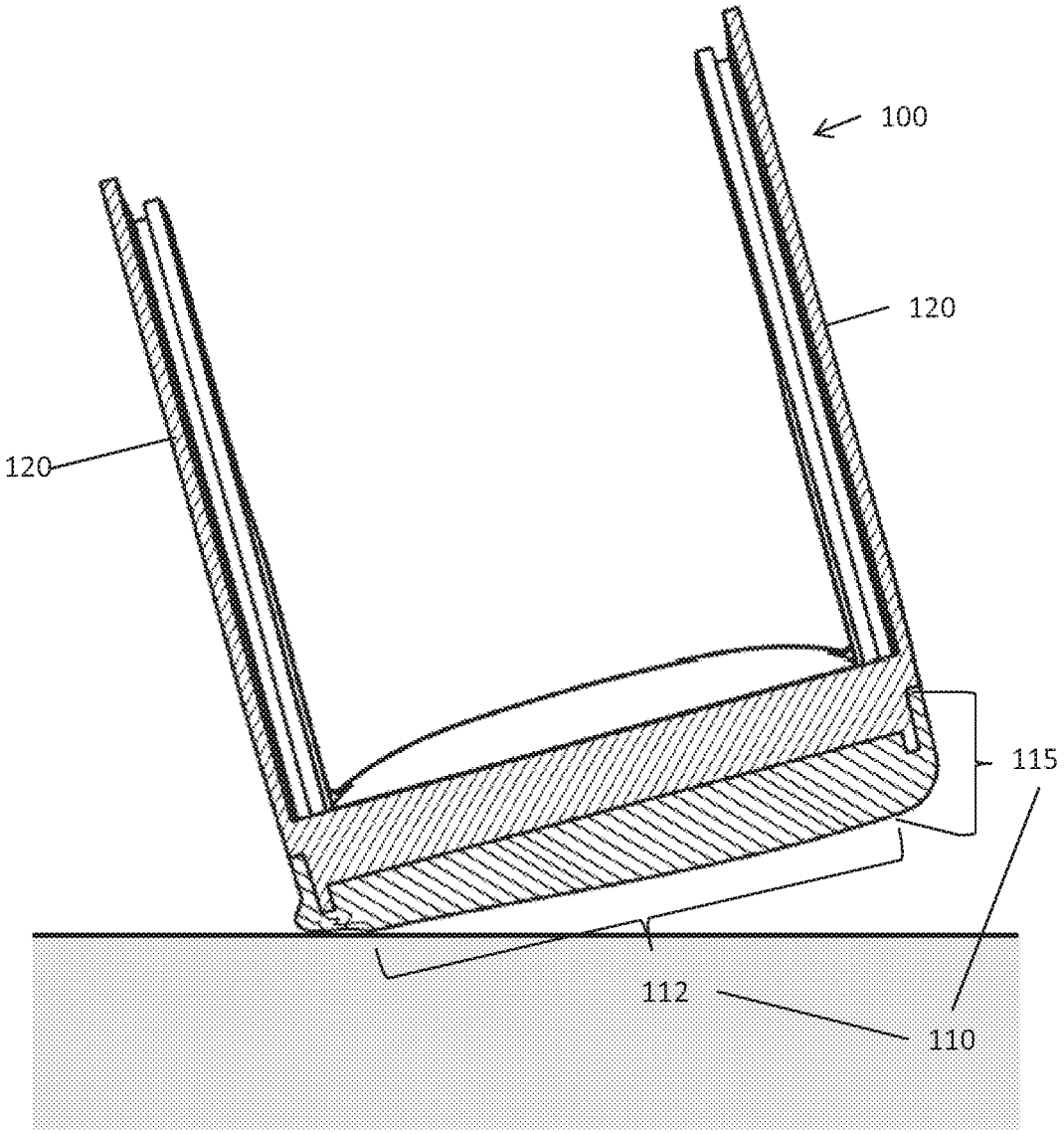
FIG. 1 PRIOR ART
FIG. 1 is a cross-section view of a prior art orthopedic walking boot in contact with a surface.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. Thus, the elements illustrated in the drawings are schematic in nature and their shapes are not intended to illustrate the precise shape of an element and are not intended to limit the scope of the present invention, unless intentionally described as such.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element such as a structure is referred to as being coupled to another element, it can be directly connected to the other element or intervening elements may also be present. Similarly, two elements may be mechanically coupled by being either directly physically connected, or intervening connecting elements may be present. It will be further understood that when an element is referred to as being "formed" on another element, it can be deposited, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if a walker in the drawings is turned over, elements described as being on the "lower" side of other elements would then be oriented on the "upper" side of the other elements. The term "lower", can therefore, encompass both an orientation of "lower" and "upper," depending of the particular orientation of the walker. Similarly, if a walker in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The detailed description set forth below in connection with the appended drawings is intended as a description of various aspects of the present invention and is not intended to represent all aspects in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Various aspects of the present invention may provide an improved short leg walker that may be fitted easily around the leg to provide support and allow ambulation for the affected limb.

Figure 2:
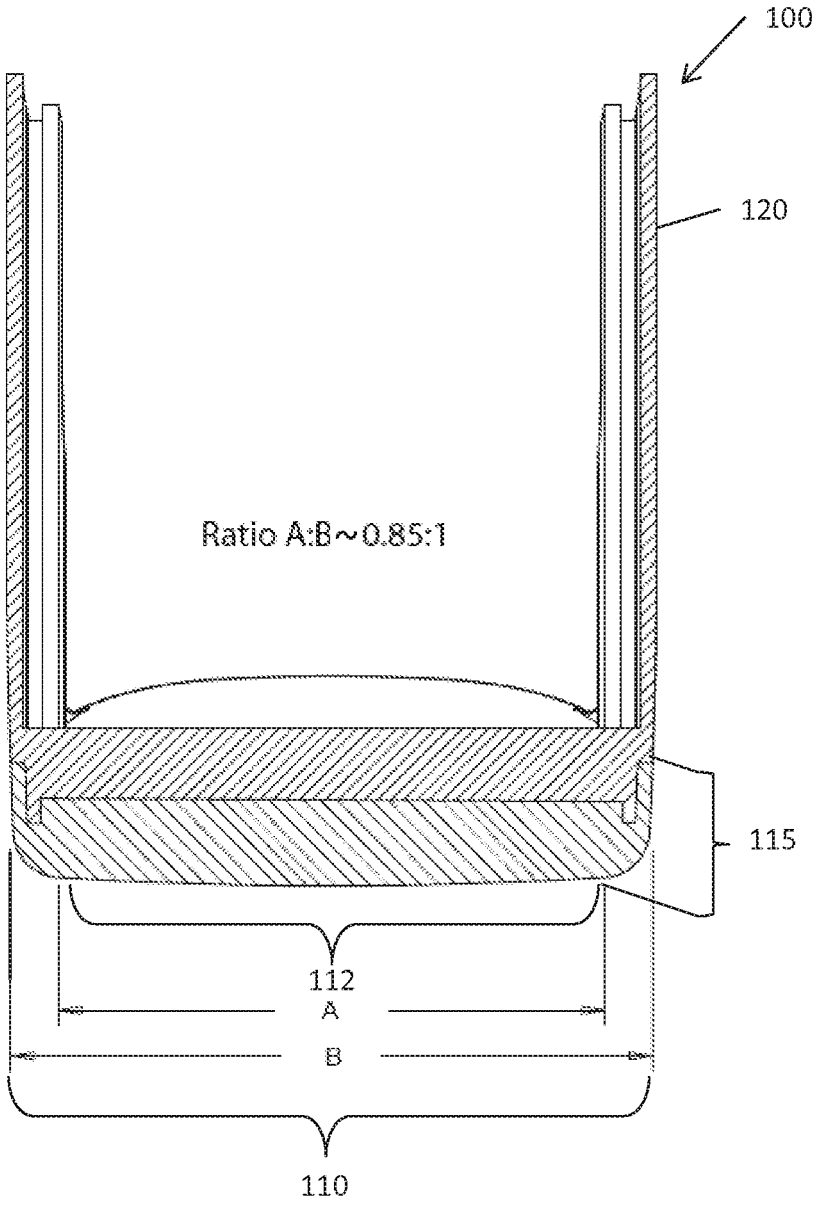
FIG. 2 PRIOR ART
FIG. 2 is a cross-section view of the boot of FIG. 1.
Figure 3A:
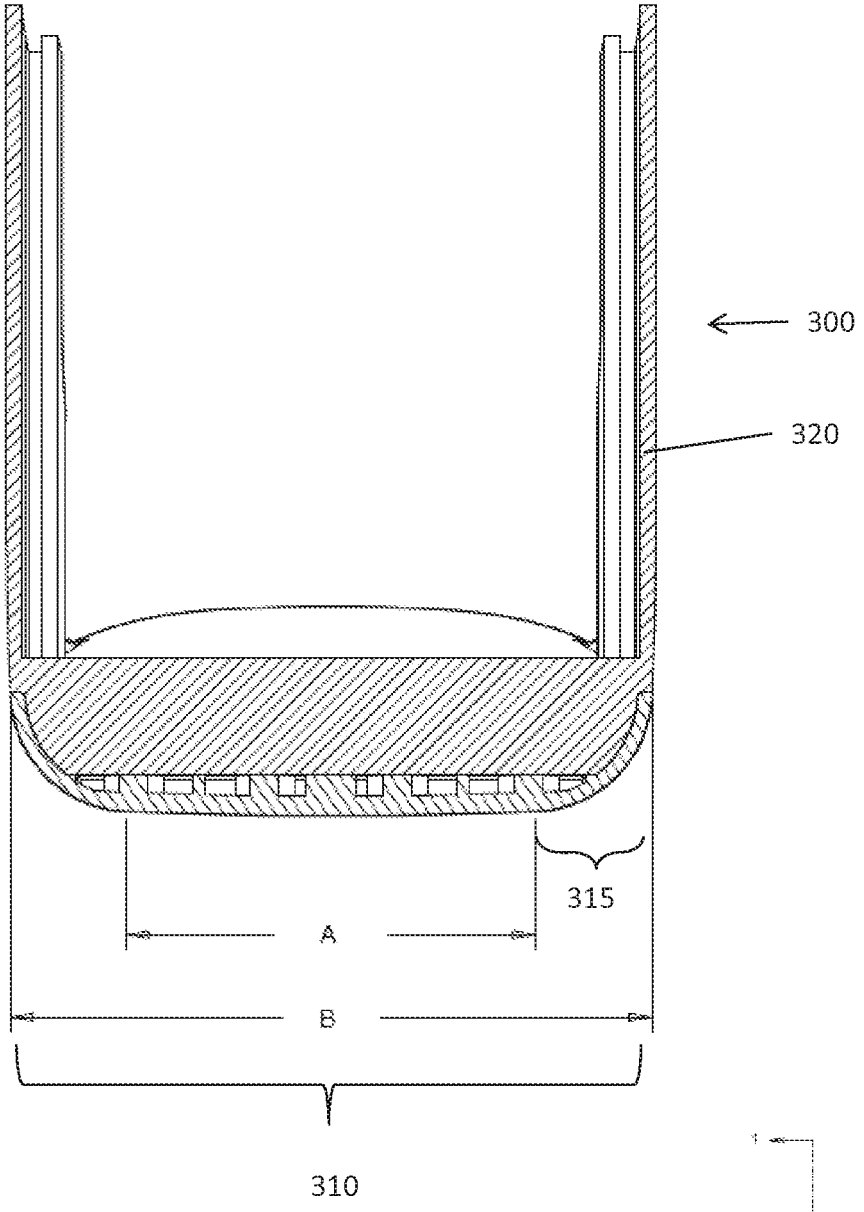
FIG. 3A is a cross-section of an orthopedic walking boot in an aspect of the disclosure.
Figure 3B:
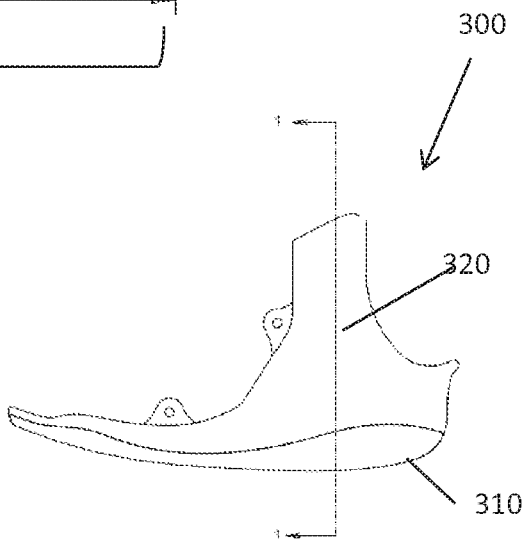
FIG. 3B is a side view of a portion of the orthopedic walking boot of FIG. 3A.

FIG. 3A is a cross-section of an orthopedic walking boot 300 for a lower portion of a user's leg, i.e., from the knee down. As shown in FIG. 3A, a full length outer sole 310 may be rounded at the sides with an arcuate edge 315 where it comes in contact with the walking surface so that the surface of the boot in contact with the ground may transition more smoothly at the edges than may be encountered in a conventional orthopedic walking boot 100. The rounded or arcuate edge 315 disclosed herein allows for the patient to lean more from side to side in the walker to maneuver more easily. With this feature, pivotal rotation of the booted foot is made easier to execute when the user wishes to turn. All portions of the outer sole 310, including the arcuate edge 315, may be fully capable of bearing the weight of the user. Traditionally, outer soles are either a die cut piece of rubber, polyurethane, thermoplastic or like material that is attached permanently to a frame of the walker. These outer soles are usually sloped in the front-to-back direction, as shown in FIG. 3B, for a front-to-back, or longitudinal, rocking action. These outer soles are usually rounded in the front-to-back direction, but not arcuate or rounded in the lateral aspect of the outer sole 310, as shown in FIG. 3A. Because the conventional boot 100 of FIGS. 1 and 2 may usually have a hard angled edge on the lateral sides of the outer sole, the patient, in an effort to assume a natural gait, will actually ride along a portion of the edge, like an ice skate blade, during part of the gait cycle. The problem arises when the patient is on uneven ground, wet surfaces or otherwise unstable surfaces. Because the patient is actually balancing on an edge, it may be more likely that edge becomes cause for the walker to slip, providing a dangerous situation for an already compromised, injured, sometimes weakened, or aged patient.

Because the foot and ankle are set at a specified angle, which may be variable, but typically may be a fixed 90 degree angle, the injured patient may normally adjust his/her gait to not only the frozen angle of the ankle, but to accommodate simultaneously for an angular relationship of the hip to the knee. This causes gross adjustments to the gait/walking patterns, including when the patient pivots to execute a turn. The curved or rounded edge—the arcuate edge 315—will allow for the patient to intuitively adapt to a more normal 3-dimensional gait pattern by being able to roll or use the edge 315 of the walker by leaning the body more side-to-side, as in a healthy walking gait, thus The patient may be more comfortable from the first strides when attempting ambulation in the walker 300. The walker may be beneficially used in a very wide range of injuries and a very wide spectral profile of patient disabilities, e.g., age, physical fitness and/or disabilities, and injury types. For example, a teenage athlete with a broken leg has a very different gate requirement and pain tolerance than an elderly, overweight, health compromised senior citizen who may also suffer other multiple chronic conditions (e.g., arthritis, hip and knee joint degradation, etc.) that can have an additional dramatic effect on gait requirements.

As the injuries progress in healing, the gait pattern may become more aggressive as the pain is eliminated when using the walker 300. Because the patient may be more comfortable at all stages of recuperation, he/she may want to adapt a more natural gait, e.g., walking, twisting, turning quickly, etc. Conscious thought is rarely given to the process of walking in our normal lives. However, people will constantly pivot around a chair, twist when exiting a car, and pivot during normal walking activity when maneuvering around or away from objects and corners, i.e., negotiating normal environments such as the household or work, changing walking surfaces, such as from carpet to hard surfaces, etc. A conventional walker with a sharp cornered arcuate side edge tends to force a wearer to walk in a straight line along that edge. A walker with a more rounded curved side edge allows for less restricted freedom to maneuver more easily. An outer sole with a relatively sharp cornered edge may result in the patient teetering and occasionally slipping or sliding on the edge. The curved surface disclosed herein allows for an easier pivot, roll, turn twist, etc., and improved contact traction on substantially any condition of the walking surface, e.g., snow, ice, rain, oily/slippery surfaces, gravel, rocks, stairs, curbs, all the surfaces we may consistently maneuver on in normal ambulatory activity, to which barely any thought is normally given.

Figure 4:
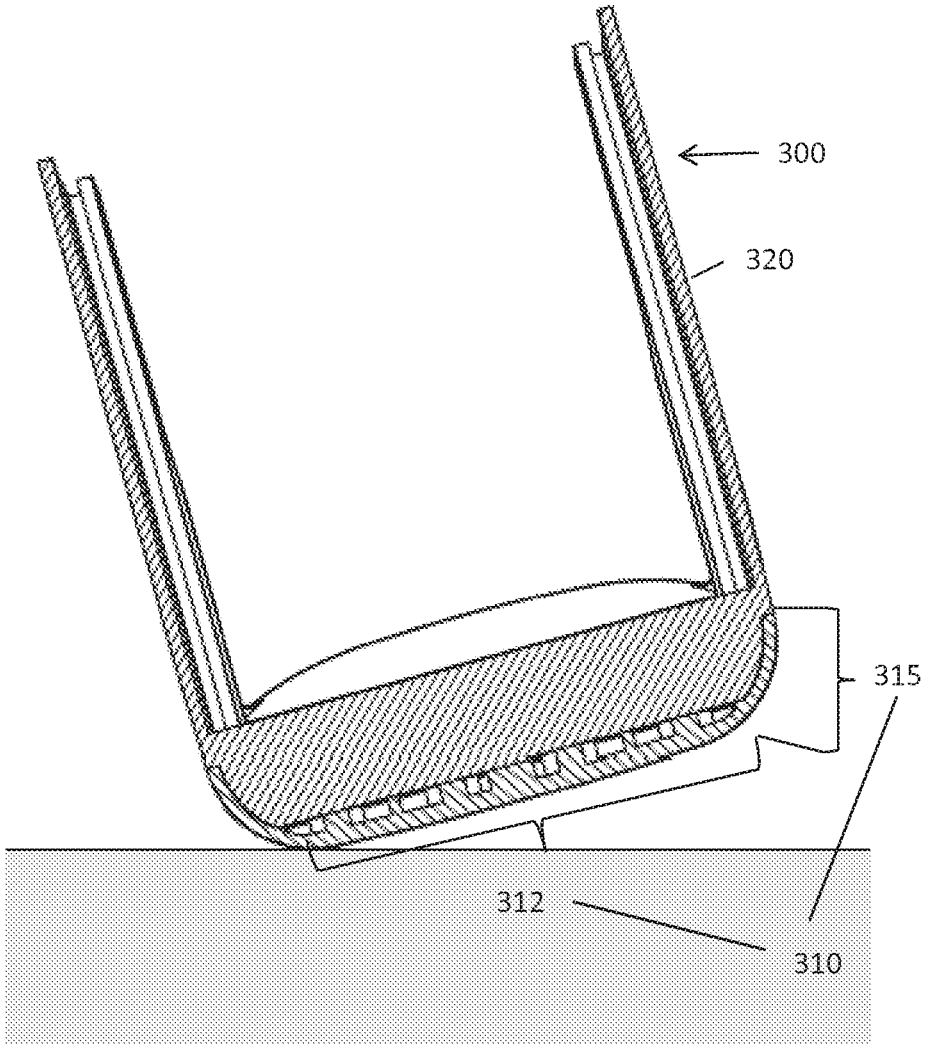
FIG. 4 is a cross-section of the boot of FIG. 3A in partial contact with a surface.

Referring to FIG. 4, the arcuate nature of the walker outer sole 310 may have a lateral profile that is continuous across the width of the entire outer sole 310 and terminate without a substantial step-off between the lateral portion 312 and the arcuate edge 315, thereby being congruent with substantially continuous curvature over the entirety of the outer sole lateral surface profile from the heel striking area to the toe. That is, a lateral portion 312 of lateral dimension A of the sole 315 may have a radius of curvature in the lateral plane that is large enough so as to appear that the lateral portion 312 is approximately or substantially flat. The arcuate edges 315 may have a radius of curvature in a smaller range which is, however still larger than for the arcuate edges 115 of the conventional walker sole 110.

A total dimension B, includes the lateral portion 312 plus the two arcuate edges 315. At the interface between the approximately or substantially flat lateral portion and each of the two arcuate edges 315 the radius of curvature changes to a smaller value, however the surface of the sole has a transition from one portion to the other, with no substantial discontinuous break in contour between the two parts (i.e., between the substantially flat or slightly curved lateral portion of dimension A and the arcuate edge 315) corresponding to a change in slope of the contour break of no more than 20 degrees. Thus, the step-off between the lateral portion 312 and the arcuate edge 315 is restricted to be equal or less than 20 degrees. For example, the radius of curvature may transition between approximately 10 mm in the region of the arcuate edge 315 to a larger value—up to infinity—in the lateral portion 312 of the outer sole 310 indicated by the dimensions A, provided there is no substantial cusp or discontinuity greater than 20 degrees of the surface smoothness from one portion to the other. More preferably, the radius of curvature in the region of the arcuate edge 315 may be approximately 30 cm. This may vary, for example, according to boot size.

A value of the radius of curvature of infinity in the lateral portion 312 indicates a flat portion of the outer sole 310. The radius of curvature in the lateral portion 312 may be in a first range of values from a minimum specified value up to infinity. The radius of curvature in the arcuate edge 315 may be in a second range of values from, for example, the minimum value specified for the lateral portion 312 down to a smaller specified value. The substantially continuous curvature over the entirety of the outer sole lateral surface profile determines that the lateral contour of the outer sole 310 changes smoothly from lateral portion 312 to arcuate edge 315, i.e., with no sharp edges greater than, for example, a 20 degree step-off It may be understood that a tread pattern in the surface of the outer sole 310 may be considered as a perturbation of the surface of the outer sole 310, and is not considered in the definition of the radius of curvature.

In a conventional walker, the ratio A:B may be on the order of 1.gtoreq.A:B.gtoreq.0.85. Commonly, the ratio may be A:B.about.0.85. In the walker boot 300 the ratio A:B may be lower, e.g., on the order of 0.85>A:B.gtoreq.0. More preferably the ratio A:B may be A:B.about.0.63.

Another feature is a scalloping or curved recessing on the inside of the walker in the upper portion 320. Traditionally the insides of the walker upper portion 120 are "flat," i.e., lack a contoured surface to accommodate the ankle The inside of the upper portion 120 of a conventional walker 100 may be interfitted into the flat inside walls in order to provide a secure fitting. Various embodiments of the walker 300 disclosed herein may have a curved or recessed inner surface (not shown) of the upper portion 320 which accommodates the natural curvature of the ankle and foot. This provides a pre-relieved area or recess to accommodate the boney prominences of the foot and ankle and also accommodates swelling patterns that are predictably present with injuries to the area.

In yet another embodiment of the disclosure, the upper portion 320, may be flared outwardly (not shown) to conform to a shape of the wearer's calf, which has an increasing cross-section of the leg with distance from the ankle.

In still another aspect of the disclosure, the outer sole may include a plurality of materials such as, for example, a primary material for structural strength, and one or more secondary materials configured to provide a greater degree of shock absorption to reduce impact stress on the user's foot, particularly from the heal to the mid-foot. The primary and secondary materials may be structurally distinct and separate over the extent of the outer sole to provide different impact characteristics according to location, or alternatively a mixture in various proportions of the primary and secondary materials may provide differing degrees of shock absorption at different locations of the sole of the foot. The mixture may be achieved by controlled additive mixing of secondary materials.

In still another aspect of the disclosure, shock attenuation to the user's foot may be achieved by including the primary and secondary materials as described above in an insole of the walker.

It may be readily appreciated that the walker boot as described above may simultaneously solve a number of deficiencies found in the prior art. These deficiencies in the prior art may include, but are not limited to, an inability to accommodate: a user's supination or pronation tendencies, changes in mobility during recovery, the need for postural accommodations including the hip, knee, back and shoulders, and desired freedom of movement on various terrains, such as, but not limited to, stairs and inclines.

The claims are not intended to be limited to the various aspects of this disclosure, but are to be accorded the full scope consistent with the language of the claims. It is noted that specific illustrative embodiments of the invention have been shown in the drawings and described in detail hereinabove. It is to be understood that various changes and modifications may be made without departing from the spirit and scope of the invention. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. .sctn.112, sixth paragraph, unless the element is expressly recited using the phrase "means for" or, in the case of a method claim, the element is recited using the phrase "step for."

We claim:

1. An orthopedic walking boot, comprising:

an upper portion having left and right side walls terminating vertically at a lowermost left and right edges, respectively;

an insole; and an outer sole having:

a longitudinal continuous curvature along an entire length of a lower surface from a front to a back of the outer sole; and a transverse continuous curvature extending from a left uppermost edge to a right uppermost edge and defined by two dimensions A and B, where A is an entire length of the transverse continuous curvature in contact with a ground surface and B is a lateral distance between the left uppermost edge and the right uppermost edge, evaluated at every longitudinal position between a heel strike area and a toe area, said transverse continuous curvature characterized by a ratio of A:B that is less than 0.63; and, wherein the transverse continuous curvature has a first radius of curvature corresponding to the A dimension and two smaller radii of curvature on first and second sides of the A dimension; wherein the transition between adjacent radii of curvature is smooth.

2. The orthopedic walking boot of claim 1, further comprising a shock absorber extending from the heel to the mid-foot.

3. The orthopedic walking boot of claim 2, wherein the shock absorber is disposed in an insole of the walking boot.

* * * * *